US005231779A

United States Patent [19]

Valiulis et al.

[11] Patent Number: 5,231,779

[45] Date of Patent: Aug. 3, 1993

[54] INFORMATION DISPLAY TAG

[75] Inventors: Stanley C. Valiulis, Rockford; Randy D. Long, Durand, both of Ill.

[73] Assignee: Southern Imperial, Inc., Rockford, Ill.

[21] Appl. No.: 757,129

[22] Filed: Sep. 10, 1991

[51] Int. Cl.[5] ..... G09F 3/20

[52] U.S. Cl. ..... 40/649; 248/207; 211/59.1

[58] Field of Search ..... 40/642, 657, 662, 663, 40/666; 248/221.1, 911, 221.3, 220.3, 220.4, 207; 211/59.1, 57.1

[56] References Cited

U.S. PATENT DOCUMENTS

| | | | |
|---|---|---|---|
| 3,452,954 | 7/1969 | Lucietto et al. | 248/221.1 |
| 3,469,813 | 9/1969 | Rizzi | 248/475.1 |
| 4,246,710 | 1/1981 | Mixer | 211/57.1 X |
| 4,319,731 | 3/1982 | Pheifer | 248/220.4 X |
| 4,351,440 | 9/1982 | Thalenfeld | 40/642 X |
| 4,452,360 | 6/1984 | Barnes | 211/59.1 |
| 4,540,093 | 9/1985 | Merl et al. | 211/59.1 |
| 4,593,824 | 6/1986 | Pheifer | 40/642 X |
| 4,674,721 | 6/1987 | Thalenfeld | 211/59.1 X |
| 4,801,116 | 1/1989 | Blankenship | 211/59.1 X |
| 4,805,861 | 2/1989 | Thalenfeld | 248/221.3 X |
| 4,934,080 | 6/1990 | Karnes et al. | 40/666 X |

*Primary Examiner*—James R. Brittain
*Assistant Examiner*—Cassandra Hope
*Attorney, Agent, or Firm*—Leydig, Voit & Mayer, Ltd.

[57] ABSTRACT

A tag for displaying pricing and other information relating to products on a merchandiser such as a "Pegboard" hook, a shelf or a rack. The tag is adapted to be attached universally to various types and sizes of scanner arms associated with the hook and also to fence-type shelves and racks.

7 Claims, 2 Drawing Sheets

INFORMATION DISPLAY TAG

BACKGROUND OF THE INVENTION

This invention relates to an information display tag for use with merchandisers such as "Pegboard" hooks, shelving or racks.

As is well know, a "Pegboard" hook is a hanger having an arm adapted to be attached to a perforated panel and adapted to support and display merchandise. A so-called scanner arm usually is spaced above the hanger arm and supports a display tag which contains pricing, stock keeping units and other information pertaining to the merchandise on the hanger arm. The scanner arm often is an elongated piece of wire extending horizontally from the display panel and terminating in a finger which extends at a right angle to the main length of the scanner arm in order to support the display tag. Light duty scanner arms are made of relatively small diameter wire while heavier scanner arms are made of larger diameter wire.

In some scanner arms, the right-angled finger extends to the left from the main length of the arm while, in other cases, the finger extends to the right. The wire finger of a so-called "Trion" scanner arm is vertical and supports a flat plate to which the display tag is attached.

Display tags are also used with fence-type shelving. Such shelving includes a plurality of forwardly extending and parallel wire rods whose forward ends are connected by a laterally extending rod which supports the display tag. In other arrangements, a fence made of wire rods extends upwardly from the front of the shelf and supports the display tag while in still other arrangements the wire rods themselves form a display rack. The rods of such shelving and racks also vary in diameter depending upon the duty requirements of the merchandiser.

SUMMARY OF THE INVENTION

The general aim of the present invention is to provide a new and improved display tag which may be used universally with scanner arms of various diameters, with scanner arms having left or right fingers, with "Trion" type scanner arms, and with various types and sizes of fence-type shelving and racks.

A more detailed object of the invention is to achieve the foregoing by providing a display tag having unique means for snapping onto and gripping right-angled rods of various diameters and orientations and having means for receiving and locating against the mounting plate of "Trion" type scanner arms.

Another object of the invention is to provide a display tag which may be tilted upwardly or downwardly at an angle on the arm so that the tag may be easily read if the arm is located at low or high elevations, respectively.

These and other objects and advantages of the invention will become more apparent from the following detailed description when taken in conjunction with the accompanying drawings.

DETAILED DESCRIPTION OF THE PREFERRED EMBODIMENT

Figure 1:
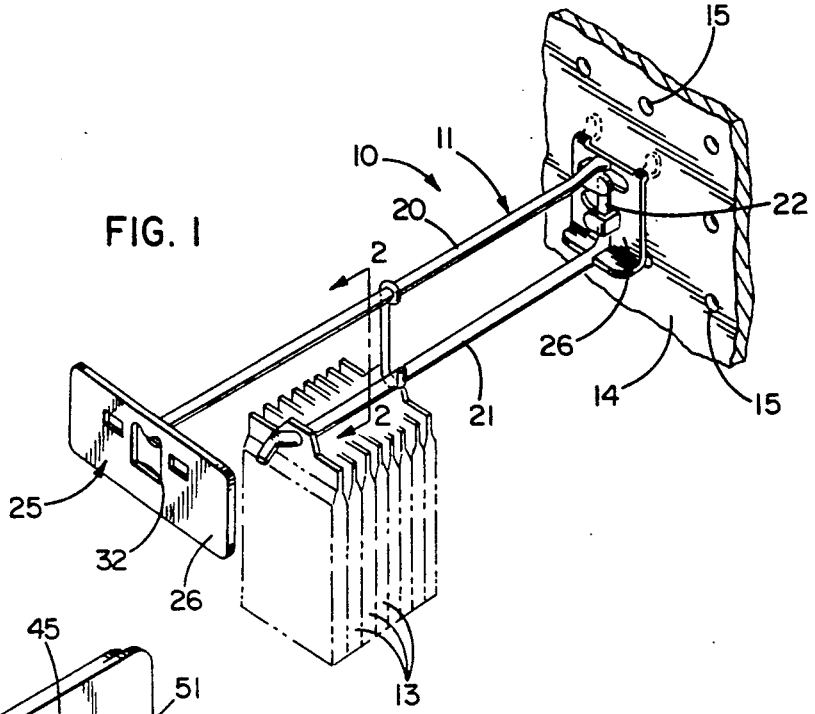
FIG. 1 is a perspective view of a typical display hanger having a scanner arm equipped with a new and improved information display tag incorporating the unique features of the present invention.

For purposes of illustration, the invention has been shown in the drawings in connection with a hanger assembly 10 having a hanger 11 for supporting one or more articles 13 from a panel or "Pegboard" 14 of the type formed with a series of vertically spaced and horizontally extending rows of holes 15. In this instance, the articles have been illustrated as being bags within which merchandise is contained. The upper end portion of each bag is formed with a hole to enable the bag to be hung from the hanger 11.

Figure 2:
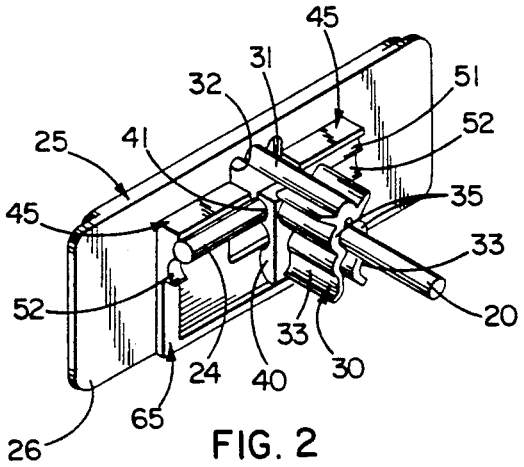
FIG. 2 is a rear perspective view showing the tag attached to the arm.

Herein, the hanger 11 is generally U-shaped and is made of round rod or wire. The hanger includes upper and lower outwardly projecting and generally horizontal arms 20 and 21 whose inner ends are formed integrally with and are joined by an upright connecting piece or connector 22. The lower arm supports the articles 13 while the upper arm is a scanner arm whose outer end is formed with a finger 24 (FIG. 2). The finger is integral with the scanner arm and extends generally horizontally from and perpendicular to the scanner arm. A tag 25 is supported removably by the finger and contains indicia such as a price, a stock number or the like which is adapted to be "read" by an electronic inventory wand.

The hanger assembly 10 further comprises a mounting bracket 23 for attaching the hanger 11 releasably to the panel 14. In this instance, the bracket is of the type disclosed in Barnes U.S. Pat. No. 4,452,360 to which reference is made for a more detailed description.

Figure 3:
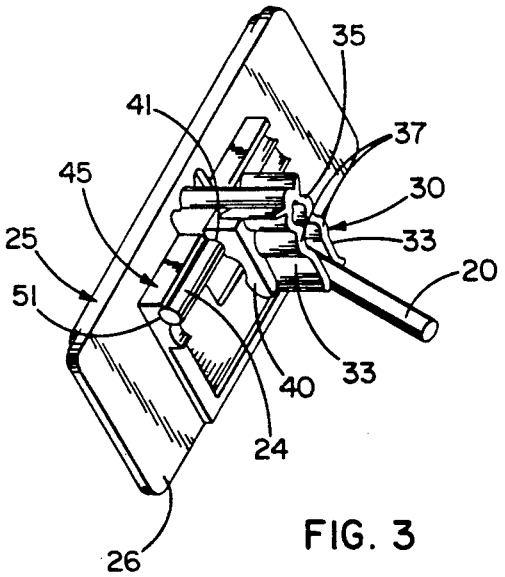
FIG. 3 is a view similar to FIG. 2 but shows the tag being attached to the arm.
Figure 7:
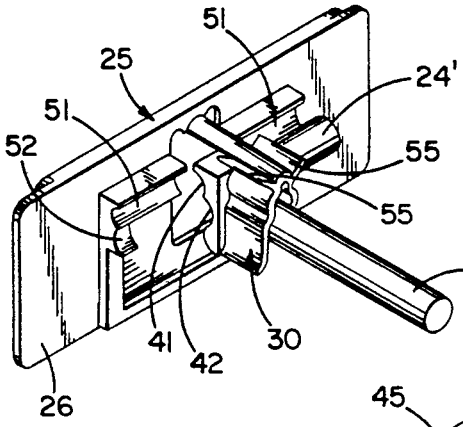
FIG. 7 is a view similar to FIG. 2 but shows the tag attached to a heavier duty scanner arm.

The scanner arm 20 shown in FIGS. 1 to 3 is a relatively light duty arm which is made of wire having a diameter of, for example, either 0.149" or 0.186". The finger 24 extends to the left from the arm when viewed from the rear of the arm. In the scanner arm 20' shown in FIG. 7, the finger 24' extends to the right from the arm when viewed from the rear of the arm. The wire of the arm 20' is heavier than that of the arm 20 and may have a diameter of 0.212" or 0.250".

In accordance with the present invention, the display tag 25 is uniquely constructed such that it may be used universally with scanner arms 20, 20' of different diameters and with scanner arms having either a leftwardly projecting finger 24 or a rightwardly projecting finger 24'. And, as will become apparent subsequently, the same display tag also may be used with other types of merchandisers.

More specifically, the display tag 25 includes a substantially flat and rectangular plate 26 molded of resiliently yieldable plastic such as polypropylene and having front and rear faces. The front face serves as a mounting surface for a label or the like which is imprinted with indicia relating to the merchandise supported by the lower hanger arm 21.

Figure 5:
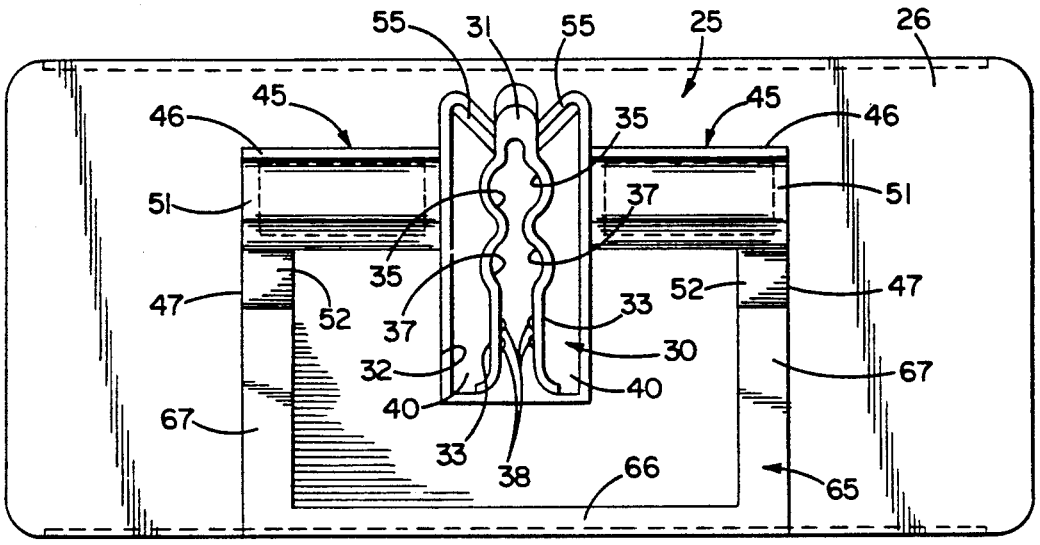
FIG. 5 is an enlarged rear elevational view of the tag.
Figure 6:
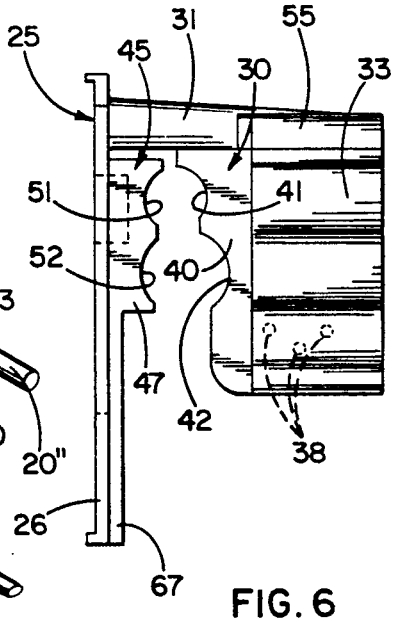
FIG. 6 is a side elevational view of the tag shown in FIG. 5.

Molded integrally with the plate 26 is a clip 30 for attaching the tag 25 releasably to the scanner arm 20, 20'. Herein, the clip includes a support bar 31 molded integrally with the rear face of the plate 26 above an opening 32 therein and projecting rearwardly from the plate. Molded integrally with and depending from the rear end portion of the bar 31 are two laterally spaced legs 33 which are adapted to be flexed and spread apart in order to enable the scanner arm 20, 20' to be placed between the legs. The upper portions of the inboard sides of the legs are formed with opposing, vertically aligned and generally semi-circular grooves 35 (FIG. 5) which are sized to snugly receive the relatively small-diameter hanger arm 20. Two similar grooves 37 also are formed in the inboard sides of the legs 33 in downwardly spaced relation with the grooves 35 and are adapted to receive the hanger arm 20'. For a purpose to be explained subsequently, the grooves 20' are identical in size and shape to the grooves 20 and, in addition, three small bosses 38 (FIGS. 5 and 6) are formed on the inboard side of each leg 32 beneath the grooves 37.

The legs 33 are spaced well rearwardly of the rear face of the plate 26. Formed on the forward side of each leg is a block-like member 40 (FIGS. 2, 5 and 6) which extends laterally outwardly from the leg, the forward side of each block 40 being spaced rearwardly from the plate 26. Upper and lower vertically spaced and parallel grooves 41 and 42 (FIG. 6) are formed in the forward side of each block 32 for receiving the fingers 24 and 24', respectively. The radius of each upper groove 41 is smaller than the radius of each lower groove 42 and is correlated with the diameter of the finger 24 while the radius of each lower groove is correlated with the diameter of the finger 24'.

Two lands 45 are molded integrally with and project rearwardly from the rear face of the plate 26 on opposite sides of the opening 32. Each land generally is in the shape of an inverted "L" and includes a relatively long horizontal portion 46 which extends to the edge of the opening 32. Each land also includes a much shorter portion 47 extending downwardly from the outboard end of the associated horizontal portion.

Figure 4:
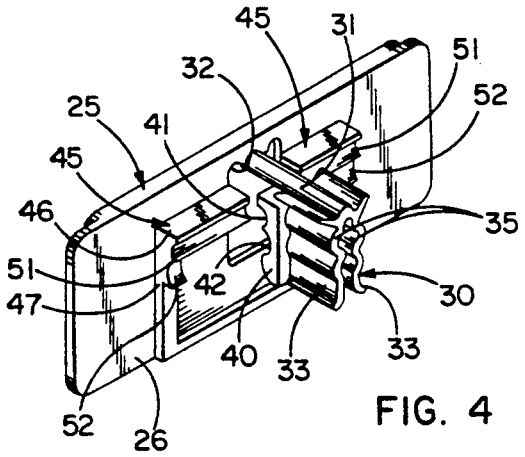
FIG. 4 is a rear perspective view of the tag.

Horizontally extending grooves 51 (FIGS. 4 and 6) are formed in the long horizontal portions 46 of the lands 45, are aligned vertically with the upper grooves 41 of the blocks 40 and are formed on substantially the same radii as the grooves 41. Downwardly spaced grooves 52 are formed in the short portions 47 of the lands 45 and are aligned vertically with the lower grooves 42 in the blocks 40. Because of the relatively large radii of the grooves 42, the front-to-rear spacing between opposing upper grooves 41 and 51 is substantially less than the front-to-rear spacing between opposing lower grooves 42 and 52.

FIG. 3 shows the tag 25 being installed on the small-diameter scanner arm 20 with the leftwardly projecting finger 24. As illustrated, the tag is tilted downwardly and forwardly and, while in this position, is pushed downwardly to cause the left block 40 and the left land 45 to move into straddling relation with the finger 24. Upon completion of downward movement of the tag, the finger 24 snaps into the upper left grooves 41 and 51 and is confined therein. At the same time, the extreme lower end portions of the legs 33 move into straddling relation with the scanner arm 20.

Thereafter, the rear end portion of the tag 25 is tilted downwardly to push the legs 33 downwardly over the arm 20. As an incident thereto, the legs are cammed apart by the arm and, when the grooves 35 in the legs reach the arm, the legs snap toward one another to cause the surfaces of the grooves to resiliently grip the arm. Such gripping of the arm, together with captivation of the finger 24 in the grooves 41 and 51, holds the tag securely in place and in a stable position on the arm and the finger.

If the arm 20 is located at a relatively high elevation on the panel 14, the tag 25 may be left in the tilted position of FIG. 3 so that the front face of the plate 25 angles downwardly to enable the customer to more easily see the information on the plate. The lower end portions of the legs 33 grip the arm sufficiently to hold the tag in the tilted position. If the arm is located at a low elevation on the panel, the tag may be inverted from the position shown in FIG. 3 and installed on the arm such that the front face of the plate 25 angles upwardly.

Installation of the tag 25 on the large-diameter arm 20' (FIG. 7) with the rightwardly projecting finger 24' is achieved in substantially the same manner as described above with respect to the small-diameter arm 20. In the case of the arm 20' and the finger 24' however, downward pushing of the front portion of the tag is stopped when the finger snaps into the lower right hand grooves 42 and 52, such grooves being capable of accommodating the large-diameter finger by virtue of their relatively large front-to-rear spacing and the comparatively large radius of the groove 42.

When the rear end portion of the tag 25 is tilted downwardly with respect to the arm 20', upwardly flaring wings 55 at the upper ends of the legs 33 may be squeezed together to open the legs and facilitate pushing of the legs onto the large-diameter arm. When the tag is fully installed, the arm 20' is located in the vicinity of the lower grooves 37 in the blocks 40 but is not totally seated in the grooves due to the relative small radii of those grooves. Even though the arm 20' is not completely seated in the grooves 37, the resiliency of the legs 33 causes the legs to grip the arm with sufficient force to hold the tag in a stable position. Also, the bosses 38 on the legs 33 engage the lower side of the arm to help retain the tag on the arm.

It will be appreciated, of course, that the small-diameter arm 20 could be formed with a rightwardly projecting finger 24 and that the large-diameter arm 20' could be formed with a leftwardly projecting finger 24'.

Figure 8:
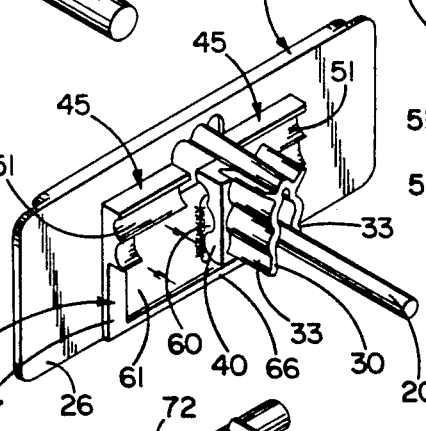
FIG. 8 is also a view similar to FIG. 2 but shows the tag attached to a "Trion" type scanner arm.

FIG. 8 shows the tag 25 in conjunction with a so-called "Trion" scanner arm 20'' of the same general type as disclosed in Thalenfield U.S. Pat. No. 4,405,051. The outer end portion of such an arm is formed with a right-angled finger 60 to which is welded an upright and generally rectangular metal plate 61 for supporting a label holder or the like.

In order to enable the tag 25 to be used with the hanger arm 20'' and the plate 61, the rear face of the plate 26 of the tag is formed with a generally rectangular frame 65 for accommodating and captivating the plate 61. Herein, the upper side of the frame is defined by the lower edges of the long portions 51 of the lands 45 while the lower side of the frame is defined by a horizontal strip 66 (FIG. 5) molded integrally with and projecting rearwardly from the lower end portion of the rear face of the plate 26. The frame is completed by two rearwardly projecting and laterally spaced strips 67 molded integrally with the rear face of the plate 26 and extending vertically between the ends of the strip 66 and the lower edges of the short portions 52 of the lands 45. The rectangular dimensions of the "window" defined within the frame 65 are just slightly smaller than the dimensions of the plate 61 of the hanger arm 20".

The display tag 25 may be installed on the arm 20" by positioning the tag with the plate 26 just in front of the plate 61 and by pushing downwardly on the tag to cause the lower pair of grooves 37 in the legs 33 to snap onto the arm 20". Thereafter, the tag may be pushed rearwardly to cause the frame 65 to embrace the plate 61 and provide edgewise stability for the tag.

Because of the relative positioning of the hanger 20" and the plate 61, the lower pair of grooves 37 in the legs 33 are the grooves which are at the proper elevation to embrace the arm. Such grooves are the same size as the upper grooves 35 in order to enable the legs 33 to tightly grip a small-diameter arm 20" (e.g., an arm 20" having the same diameter as the arm 20). If the arm 20" is of larger diameter (e.g., similar to the arm 20'), the legs 33 grip the arm 20" in the same manner as they grip the arm 20'.

Figure 9:
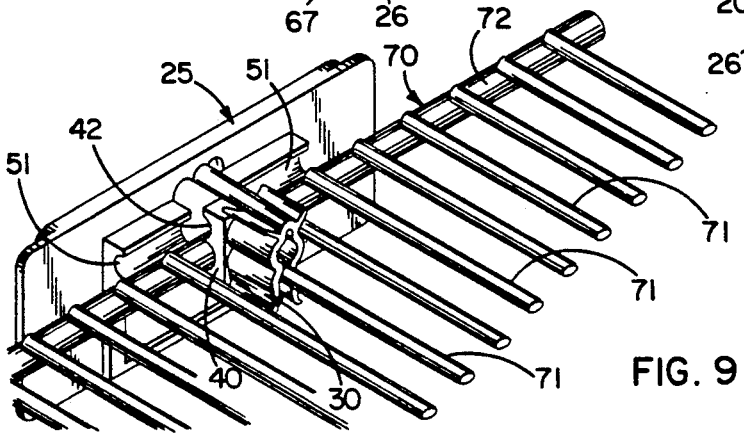
FIG. 9 is a perspective view showing the tag attached to a fence-type shelf.

Advantageously, the tag also may be used on a fence-type shelf 70 such as shown in FIG. 9. Such a shelf includes several parallel horizontal rods 71 extending in a fore-and-aft direction and connected at their forward ends by a larger diameter rod 72 extending perpendicular to the rods 71. The display tag 25 is installed with the rod 72 seated within the lower grooves 42 and 52 and with one of the rods 71 received in the lower grooves 37.

In some instances, a fence-like structure similar to that shown in FIG. 9 is disposed in a vertical plane to form a display rack, the rod 72 being at the top of the rack. The tag 25 may be used with such a rack and still face forwardly by turning the tag relative to the rack through 90 degrees from the position shown in FIG. 9, by seating the rod 72 in the grooves 42 and 52 and by placing the clip 30 between adjacent rods 71 such that the blocks 40 engage such rods and restrict lateral movement of the tag.

From the foregoing, it will be apparent that the present invention brings to the art a new and improved display tag which is capable of being used universally with scanner arms of different sizes and types and also with fence-type shelves and racks. As a result, the tag eliminates the need for making and stocking several different tags for different merchandisers. Also, the tag lends itself to being tilted on arms located at high or low elevations so as to enable clearer viewing of the information on the plate 25 of the tag.

We claim:

1. An information display tag for use with a merchandiser having a first generally horizontally extending rod and a second rod joined to and extending substantially perpendicular to the first rod, said tag comprising an upright plate molded of resiliently yieldable plastic and having front and rear faces, and attaching means molded integrally with the rear face of said plate, said attaching means comprising a clip having front and rear faces with the front face of the clip being spaced rearwardly from the rear face of said plate to permit the second rod to be placed between the plate and the clip, said clip comprising a pair of laterally spaced and vertically extending legs having upper ends joined to one another and having lower ends spaced from one another whereby said legs may be spread apart to enable said first rod to be placed between said legs, said legs having opposing inboard sides for gripping said first rod, a pair of opposing grooves formed in the inboard sides of said legs for receiving said first rod, a second pair of opposing grooves formed in the inboard sides of said legs and spaced vertically from said first pair of grooves, first groove means formed in the front face of said clip and having portions extending horizontally in opposite directions from said legs, second groove means on the rear face of said plate and having portions extending horizontally in opposite directions from said legs, said first groove means being aligned vertically with said second groove means.

2. A tag as defined in claim 1 in which said first and second groove means are sized to captivate said second rod.

3. A tag as defined in claim 1 in which said second pair of grooves is substantially identical to said first pair of grooves.

4. A tag as defined in claim 1 in which said first groove means comprise upper and lower vertically spaced and parallel first grooves formed in the front face of said clip, said second groove means comprising upper and lower vertically spaced and parallel second grooves on the rear face of said plate and aligned vertically with and spaced horizontally from said first grooves, the horizontal spacing between said upper first groove and said upper second groove being less than the horizontal spacing between said lower first groove and said lower second groove.

5. A tag as defined in claim 1 further including means defining a generally rectangular frame on the rear face of said plate.

6. A tag as defined in claim 1 further including a finger extending forwardly from said clip above said first groove means and joining said clip to said plate.

7. An information display tag for use with a merchandiser having a first generally horizontally extending rod and a second rod joined to and extending substantially perpendicular to the first rod, said tag comprising an upright plate molded of resiliently yieldable plastic and having front and rear faces, and attaching means molded integrally with the rear face of said plate, said attaching means comprising a clip having front and rear faces with the front face of the clip being spaced rearwardly from the rear face of said plate to permit the second rod to be placed between the plate and the clip, said clip comprising a pair of laterally spaced and vertically extending legs having upper ends joined to one another and having lower ends spaced from one another whereby said legs may be spread apart to enable said first rod to be placed between said legs, said legs having opposing inboard sides for gripping said first rod, first groove means formed in the front face of said clip and having portions extending horizontally in opposite directions from said legs, second groove means on the rear face of said plate and having portions extending horizontally in opposite directions from said legs, said first groove means being aligned vertically with said second groove means, said first groove means comprising upper and lower vertically spaced and parallel first grooves formed in the front face of said clip, said second groove means comprising upper and lower vertically spaced and parallel second grooves on the rear face of said plate and aligned vertically with and spaced horizontally from said first grooves, the horizontal spacing between said upper first groove and said upper second groove being less than the horizontal spacing between said lower first groove and said lower second groove.

* * * * *